US005320362A

United States Patent [19]

Bear et al.

[11] Patent Number: 5,320,362

[45] Date of Patent: Jun. 14, 1994

[54] COMPUTER CONTROLLED AMUSEMENT STRUCTURE

[76] Inventors: Thomas Bear, 6559 Kolb; Robert Jordan, 15402 Angelique, both of Allen Park, Mich. 48101

[21] Appl. No.: 116,507

[22] Filed: Sep. 7, 1993

[51] Int. Cl.[5] ..... A63B 71/02; F41J 5/00

[52] U.S. Cl. ..... 273/440; 273/311; 273/445; 273/454; 273/460; 472/66

[58] Field of Search ..... 273/440, 311, 313, 444, 273/445, 446, 454, 460, 310; 472/62

[56] References Cited

U.S. PATENT DOCUMENTS 4,695,058 9/1987 Carter, III et al. ..... 273/311
5,127,657 7/1992 Ikezawa et al. ..... 273/310
5,219,316 6/1993 Huffman ..... 472/62

*Primary Examiner*—William H. Grieb
*Attorney, Agent, or Firm*—Krass & Young

[57] ABSTRACT

An amusement system for use by one or more participants includes weapons which may be carried, aimed and triggered by the participants to fire objects, such as paint balls, or electromagnetic energy, such as laser light. The participants wear sensors which generate signals upon participant being "hit" by an emission. The system includes a structure having a series of elongated passageways. Each passageway is divided by a central wall into a pair of trackways which lead from common entrance area at one end to a gaming area at the opposite end. Viewing areas in which the activities of the participants in the gaming area may be observed are disposed adjacent to the gaming area. Sensors are disposed along the passageways and in the gaming areas to detect the positions and activities of the participants to provide the signals to a central computer. The computer controls active displays disposed along the passageway and in the gaming area which simulate weapons and special sound and visual effects such as explosions and the like and displays which provide information to the participants as to their scores. The computer generates scores based on signals from the sensors to evaluate the players.

12 Claims, 2 Drawing Sheets

COMPUTER CONTROLLED AMUSEMENT STRUCTURE

FIELD OF THE INVENTION

This invention relates to electronic amusement systems of the type having simulated shooting games and to a system employing a structure which interacts with participants of the games.

BACKGROUND

The development of lightweight, relatively inexpensive, battery-powered electronic transmitters and receivers has led to amusement systems which allow one or more participants to engage in simulated warfare. Each participant carries a "weapon" which can be triggered to send out a directional emission. Participants wear sensors which can detect a "hit" by an opponent.

U.S. Pat. No. 4,695,058 discloses an amusement shooting game of this type which is played in a structure including paths along which the participants move and obstacles which they must negotiate to locate and hide from their "enemy." A central computer includes sensors which monitor the operation of the game in terms of the locations of the players and their hits upon one another and generates scores which are displayed to the players and special effects such as sounds and explosions. Systems of this type can provide the players with the "virtual reality" of a battlefield.

Somewhat related amusement systems have been developed in which the weapons carried by the players can be used to fire "paint balls" at opponents. The paint balls consist of thin plastic capsules carrying a marking fluid, which break upon impact with an object or another player to mark a "hit." Electronic sensors can detect a hit and score a player's performance.

An independent development is on the rise in popularity of in-line roller skates or "roller blades." This has led to the development of arenas in which the skaters repetitively skate in circles.

SUMMARY OF THE INVENTION

The present invention is directed toward an amusement system which allows participants, preferably wearing in-line roller skates, to move about a specially designed structure and engage in an electronic shooting game simulating warfare which is controlled and scored by a central computer. The system thus allows participants to be simultaneously drawn into the highly realistic virtual reality of a war game and experience the mobility and exercise provided by in-line roller skating.

A preferred embodiment of the invention, which will subsequently be disclosed in detail, employs an amusement structure incorporating a connected series of elongated passageways each divided into a pair of parallel trackways. Each passageway leads to an enlarged gaming area in which two or more participants who have passed through the passageway can meet and do battle with one another. A viewing room is disposed adjacent to each gaming area and includes windows to allow the observation of activities within the gaming area from the viewing room. The gaming area provides access to the entrance to a second passageway with a second gaming area at its opposite end. Any number of passageways, gaming areas and viewing rooms may be combined.

Computer controlled displays and sensors are positioned along the passageways and in the gaming areas and are controlled by a central computer. The players carry markers or radiation transmitters which allow them to be identified by sensors. Certain displays direct the players to shoot at targets and in the gaming area they can shoot at their opponents. The forward progress and shooting skills of each player are monitored by the central computer. Sounds and visual effects simulating battle conditions such as explosions, and gunfire are provided by the displays.

The central computer calculates the performance of each player and generates displays informing the participant s of their scores.

The weapons carried by each player may include paint ball guns or laser guns or the like.

The amusement structure is relatively flexible and low in cost and may be easily set up in a large building so that it may be modified on a periodic basis to maintain an interesting level of activity for peak users.

BRIEF DESCRIPTION OF THE DRAWINGS

Other objectives, advantages and applications of the invention will become more apparent from the following description of a preferred embodiment of the invention. The description makes reference to the accompanying drawings in which.

DETAILED DESCRIPTION OF THE PREFERRED EMBODIMENT

Figure 1:
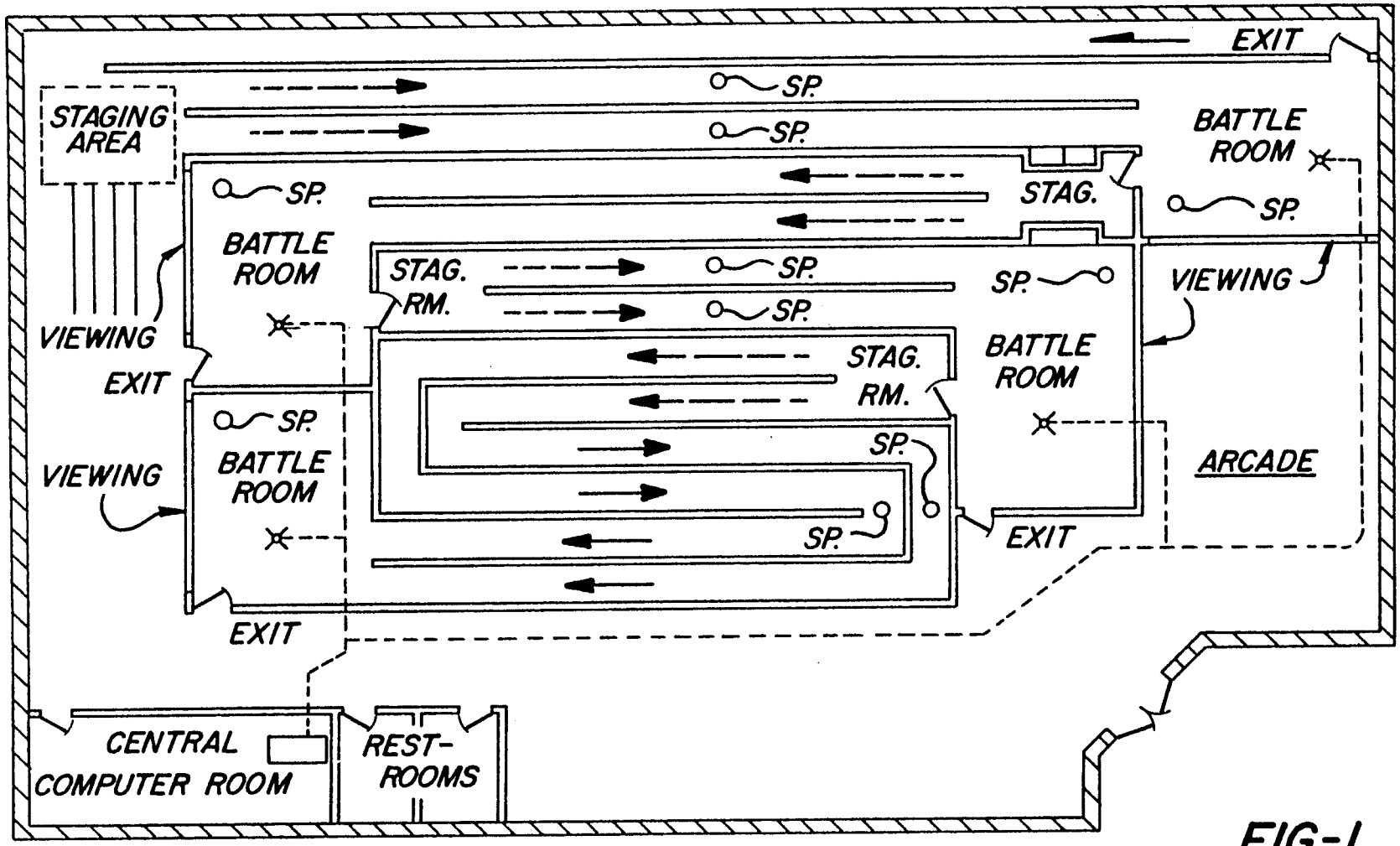
FIG. 1 is a plan view of an amusement structure comprising a preferred embodiment of the invention.

The amusement structure of the present invention is contained within a specialized building and a preferred embodiment of the structure is illustrated in plan view in FIG. 1. The building, generally indicated at 10, is preferably a single-storied structure or a walled-off section of a larger structure, having an outer wall 12. The structure is generally rectangular and typical dimensions may comprise a length of from 100 to 300 feet and a width of from 100 to 200 feet. An entrance 14 is provided to the structure 10 and zoning requirements and safety considerations will generally require an emergency exit 16. The structure 10 preferably has a ceiling height of at least 8 feet although a higher ceiling, such as 16 feet is preferred.

A structure 10 includes user amenities such as restrooms 18 and further includes an office and central computer room 20. A computer 22 which controls the operation of the games played in the structure 10 is located in the room 20.

The gaming is formed by a series of elongated passageways, each divided by a central wall into a pair of parallel trackways. While the passageways in the preferred embodiment are straight, in alternative embodiments of the invention the passageways could be curved or include angled bends. The first elongated passageway in the preferred embodiment is formed by a pair of outer walls 24 and 26 separated by a central divider wall 28 into a pair of trackways 30 and 32. The outer walls 24 and 26 of the passageway and the central divider wall 28 preferably extend between the floor and ceiling of the structure, but in alternative embodiments the divider way 28 might only extend partially to the ceiling.

The inner wall 26 of this first passageway also forms one wall of a second passageway, in cooperation with a second wall 34. A central divider wall 36 separates the second passageway into a second pair of raceways. Similarly, the wall 34 cooperates with another wall 38 to form a third passageway, divided into a third pair of trackways by a central divider wall 40. The fourth and final passageway is "S"-shaped in configuration and is formed by an S-shaped central divider wall 42 and outer passageway walls 44 and 46 which connect at right angles to one another and to the wall 38 and right angle wall sections 48, 50 and 52.

Entrance to the pair of trackways that characterize each passageway is from a common area at one end of the trackway. Entrance to the first passageway defined by the outer walls 24 and 26 is from a common staging area 56. Each pair of trackways in a passageway lead to a common gaming area, termed a "battle room" disposed at their opposite ends. The first passageway defined by the outer walls 24 and 26 leads to a battle room 58. Similarly, the second passageway, characterized by the outer walls 26 and 34, leads from an entrance staging area 60 to a common battle room 62 at the opposite end. The third passageway, defined by the outer walls 34 and 38, leads from a common entrance staging room 64 and exits to a battle room 66. Similarly, a staging room 68 provides entrance to the fourth, S-shaped trackway, which has a battle room 70 at its common exit.

Each of the first three battle rooms 58, 62 and 66 has one entrance door to the staging area for the next passageway for use by a winner of a battle game played in that room, and a separate exit area for the loser. A door 72 connects the first battle room 58 with the staging area 60 that forms the entrance to the second set of raceways. A second door 74 from the battle room 58 leads to an exit passageway 76 formed by an outer wall of the structure 12 and the first passageway wall 24. The exit passageway 76 leads back to the entrance to the first passageway. Similarly, door 78 connects the second battle room 62 to the staging area 64 for the third passageway and an exit door 80 allows the loser of the battle in the room 62 to return to the main entrance area. The victor in a game played in the third battle room 66 may move through door 82 to a staging area 68, providing entrance to the final passageway, and the loser may pass through an exit door 84 to the main entrance area. The final battle room 70 has a single exit door 86 to the common entrance area.

The activities in each of the battle rooms or gaming areas may be observed through a window from a viewing area disposed adjacent to the battle room. In alternative embodiments the viewing could be by closed circuit television. A window 90 allows observers positioned in a viewing area 92 to observe activities in the first battle room 58. A window 94 allows viewers positioned in an area 96 to observe activities in the second battle room 62. A window 98 allows observation of activities in the third battle room 96 to viewers disposed in the area 92. A window 100 allows viewers stationed in the area 96 to observe activities in the final battle room 70.

As thus far described, the structure 10 allows a variety of games to be played either by a single participant attempting to achieve a maximum score as determined by the computer 22, or by multiple participants playing against one another. Each participant starts out in the staging area 56. Upon receipt of an appropriate signal from a display controlled by the computer 22, the participant moves through one of the first passageways to the battle room 58. The participant then engages in battle activities either with one or more competitive participants and/or against displays controlled by the computer. These battle activities are served through the window 90 by viewers in the observation area 92. If two participants are involved, the winner, as determined by the computer, under the direction of a display or audio command generation by the computer, exits the door 72 for the second staging area 60 while the loser leaves the gaming area through the door 74 to the exit area 76. The winner of this first battle waits in the staging area 60 for next winner among two subsequent participants. When the second winner enters the staging area 60 a display from the computer allows the two winners of the previous two battles to race along the second passageway and to engage one another in the battle room 62. This process continues, with the winner of each battle awaiting the winner of the next battle before proceeding on through the next passageways. The losers return to the entrance area and may participate in additional battles or simply view the continuing battles.

Figure 2:
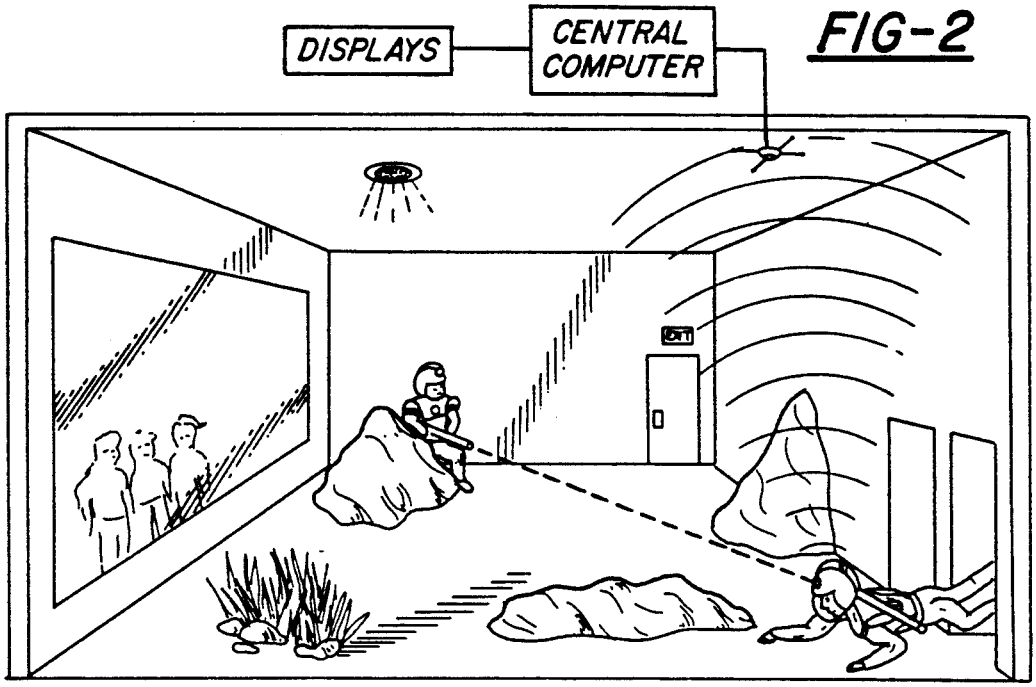
FIG. 2 is a perspective view of a gaming area illustrating two participants engaging in battle.

The central computer 22 controls, operates and scores the games by means of sensors and displays disposed in the passageways and in the battle rooms. While a wide variety of games may be played in the structure of Figure 1, FIG. 2 illustrates a form of game in which two participants 110 and 112 are each equipped with laser "guns" 114 which are adapted to shoot a laser beam when triggered by the participant, and each participant wears a helmet 116 and a vest 118 equipped with sensors for detecting a laser beam from an opponent's laser gun and thus signalling a "hit." The helmets 116 and vests 118 are equipped with radio transmitters which generate a distinctive signal when a "hit" has occurred. The transmitted signals are picked up by an antenna 119 disposed in the gaming room and provided to the central computer 22.

FIG. 2 illustrates a typical battle room which may be observed through a window 94. A participant enters the room from passageways characterized by outer walls 26 and 34 and a central divider 36. Each battle room is equipped with artificial obstacles 120, simulating rocks or the like, which can provide shelter and hiding places for the participants.

A display 122 is supported on one wall of the gaming room and connected to the central computer 22. The display, which may be a projection or flat panel display, preferably serves three functions: first, it displays the scores of the participants at any time in the games; second, it displays directions for progress of the game, such as a message to one of the participants that he has lost the game and should move through the exit area 88; and third, the displays simulate active forces in the game such as a source of laser gunfire. Similar forms of display are arrayed along the passageways.

In FIG. 1 certain of the displays 122 and sensing antennas 119 are indicated.

As illustrated in FIG. 2, the participants preferably wear in-line roller skates 126 which increases the difficulty of the game and introduces their speed and skating skill as a factor in the game.

Figure 3:
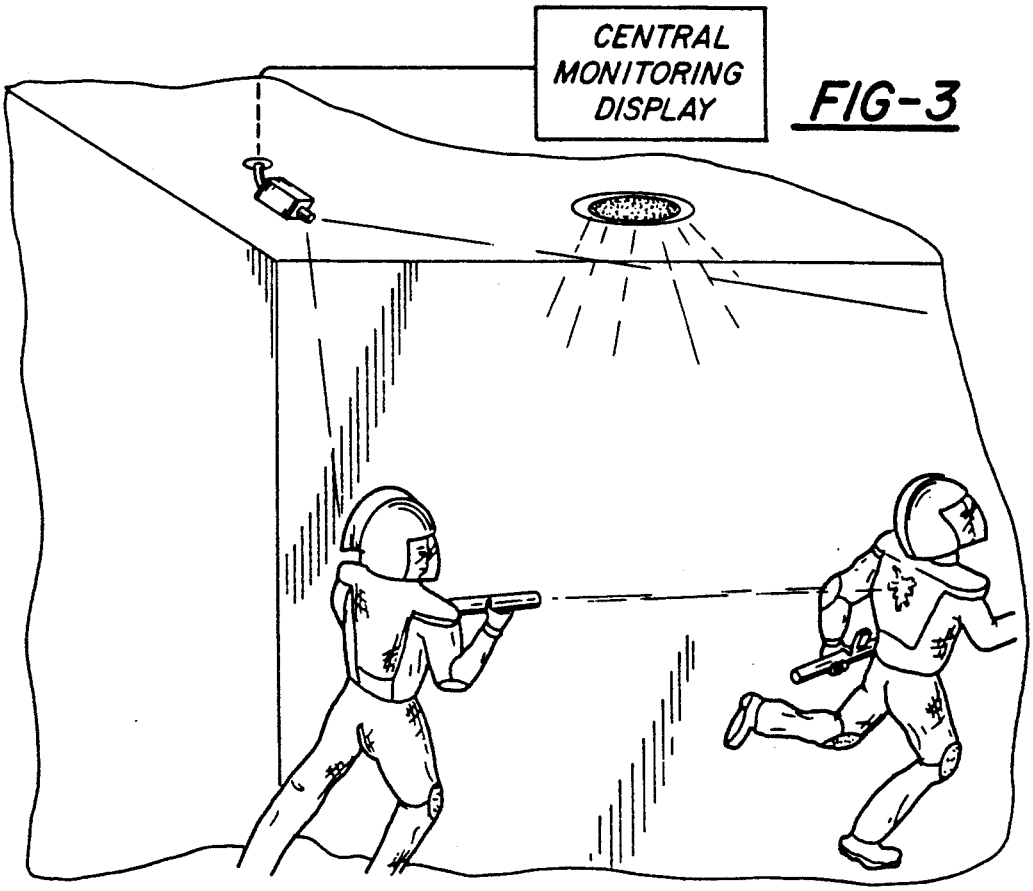
FIG. 3 is a detailed view of a second gaming area illustrating two participants engaged in battle and illustrating sensors and displays.
Figure 1:
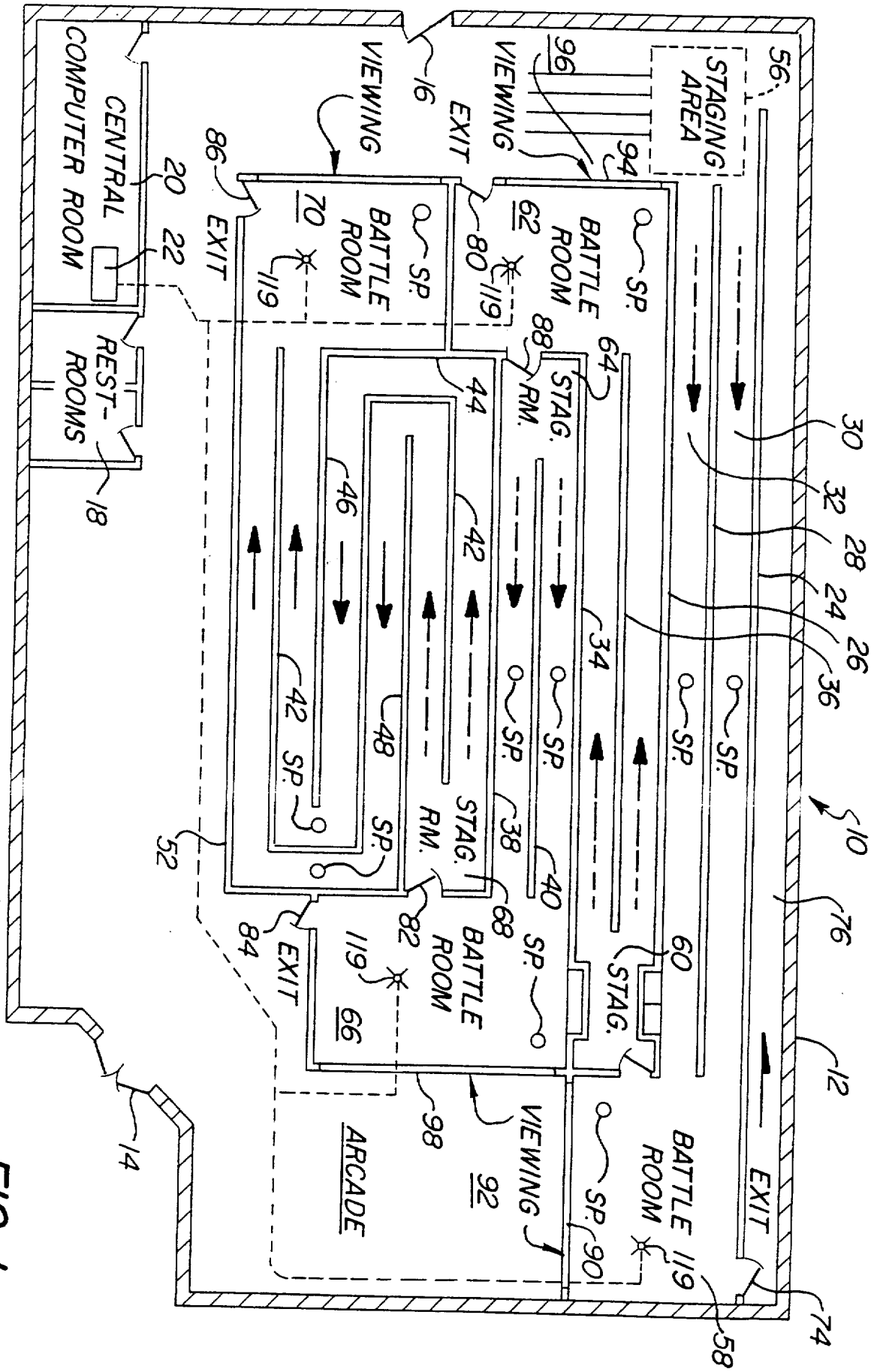
Figure 2:
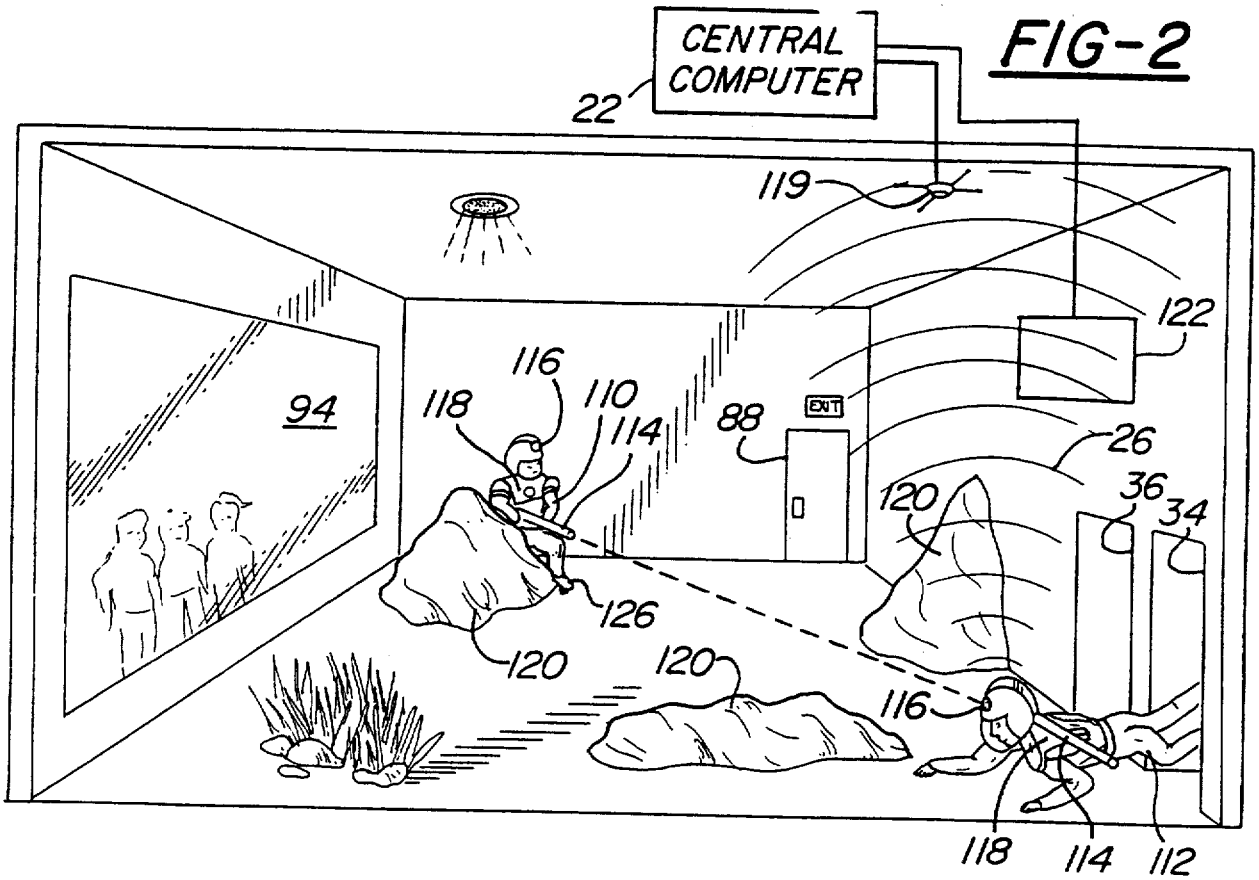
Figure 3:
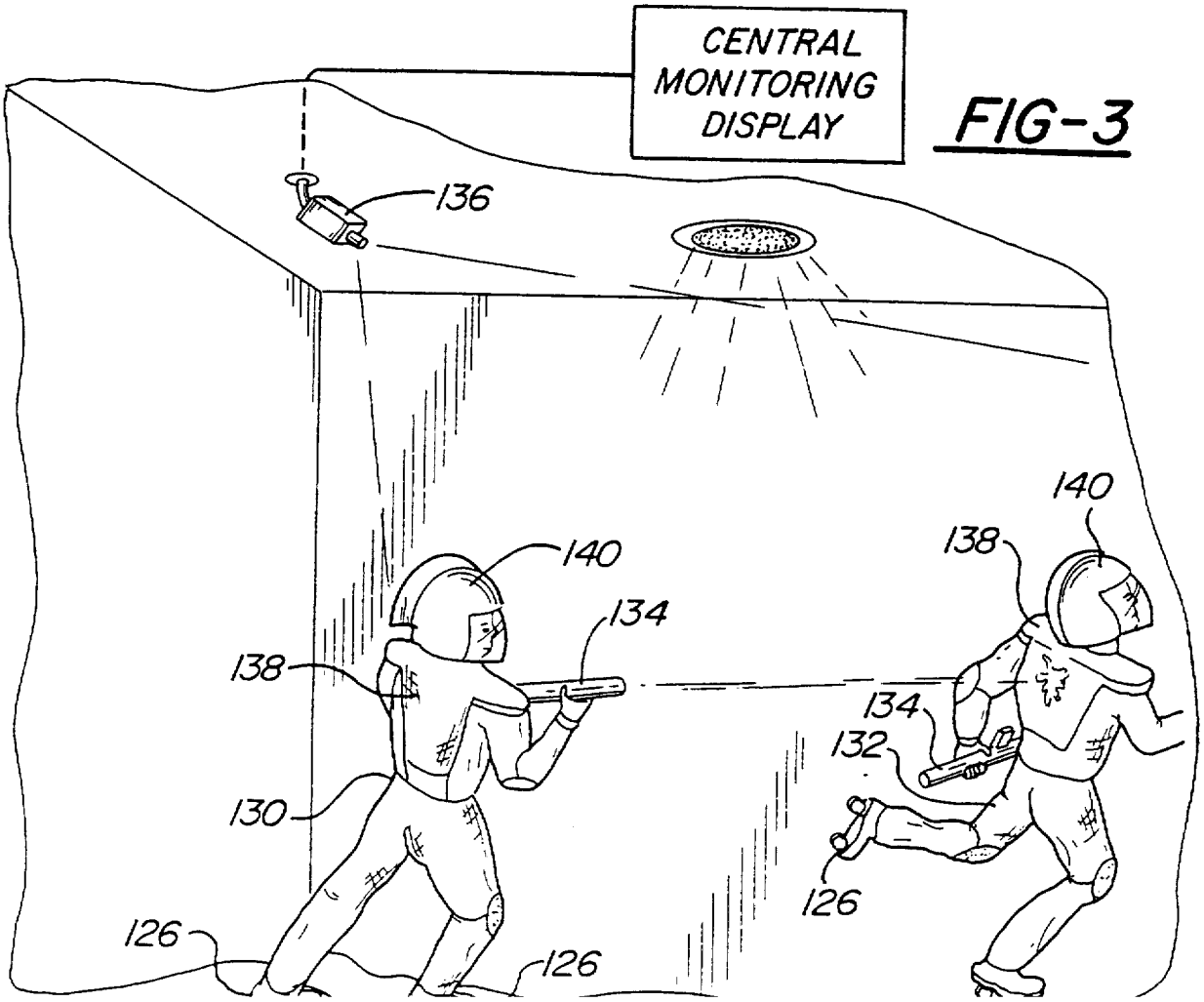

FIG. 3 illustrates an alternative form of the game in which two participants 130 and 132, wearing in-line skates 126, carry paint ball guns 134 rather than laser guns. A computer sensor 136, supported in the ceiling of the battle room, comprises a television camera. The computer receives the camera signal and performs pattern recognition analysis to detect when one participant has been hit by a paint ball from the other participant's gun. Participants preferably wear color-coded jackets 138 and helmets 140 so that the computer can distinguish the players.

Alternatively, the sensor may constitute a microphone which monitors the sounds produced by impact of a "bullet" against plastic shields mounted to the front and back of the player. A human referee might also monitor the action and hit a button to signal to the computer each time a player is hit. The systems using paint balls immediately after the game, the players may stand in front of a backdrop which matches the color of their suit and a T.V. camera could analyze their appearance and transmit a signal to the computer which will perform an image analysis to contrast dark from light and determine the amount of paint on a player.

Alternatively, the system may not incorporate gaming areas but rather, computer grade of the players based on their shooting accuracy and speed. The players move along the trackways as fast as they can while hitting as many targets as they can. The computer scores each player based on the elapsed time spent covering the distance of the course and the number of targets hit. In this version the divider walls may be relatively short so that two players can play the game at the same time and may be able to judge their speed by observing each other.

At the beginning of the game each player is given an identification recognizable by the computer in terms of color of the participant's garments or the code of signals transmitted by sensors worn by the participants. The sensors 119 which may include infrared sensors as well as antennas, to monitor the progress and shooting skills of the participants as they progress through the games. The computer also, preferably, monitors the number of people in line to play the game and automatically determines the number of passageways that the winner must progress through. During extremely slow volume periods the computer may restrict play to the first passageway.

Computer sensors, displays and simulators and the walls of the building are preferably modular and can be adjusted in number and position depending upon the requirements of the situation. Trackways are preferably equipped with exterior cable raceways with removable covers for housing the control cable which connects the central computer 22 to the sensors, displays and simulators. All trackways are preferably equipped with a row of light sockets that run parallel with the floor approximately six feet off the floor. The floors of straight trackways may be adjusted up or down either at both ends to allow for incline, decline or raised levels. The walls of the tracks are generally eight feet high but the top four feet are preferably removable. The tracks are preferably at least four feet wide.

A variety of games may be performed within the structure. Broadly, the players may oppose one another or teams of players may oppose other teams, or alternatively one or more players may play to maximize their scores as calculated by the computer. In the paint ball variety of the game, opposing the computer affords the participants an opportunity to get a feel for the basic game without any risk of being hit by a paint ball. The computer simulates shooting, through displays 122, but does not actually shoot paint balls. The participant's scores increase when they achieve certain objectives. For example, a display may simulate a sniper that a participant can shoot with his gun to gain points. Failure to hit the target will result in a loss of points because the computer will register one or more hits against the players as they progress through the game. Each team or individual playing in this mode is scored by the computer and the score is recorded in the player's database.

When opposing one another each player's score is tracked separately by the computer. The participants not only must deal with simulated opponents generated by the computer but can also score points by hitting the opposing player.

Following are three typical types of games:

Game Type 1—A team of 2 or one individual player plays to attain the maximum score as calculated by the computer. The playing time is regulated by the computer but is estimated to be about 4–5 minutes per level Players are allowed to progress through all levels. In each level and in the passageways leading to each level, the player must hit certain targets within specific time frames in order to achieve a high score.

Game Type 2—Two individuals play against each other. Points are scored when a player hits an opposing player or a target monitored by the computer. Points are lost when a player is shot by an opposing player or if the player fails to achieve objectives required by the computer. The playing area is limited to the first level. Estimated playing time is approximately 6–8 minutes. The player who scores highest, is allowed to play again at no charge.

Game Type 3—This game is like game 2 except that the winning player in each level is allowed to move on to the next level. The winning player in each level goes into a staging area for the next level and waits until the next winner is finished in the level just finished. The losing player at any level is normally directed directly from that level through a different door. (During slow traffic periods, the computer may allow a losing player to pass to the next level as an option in order to keep the winning player from waiting around too long for an opponent.) The length of time in each level is reduced to about 6 minutes. Any player who is victorious after all 4 levels is allowed to play again. The computer tracks the performance of each player every time he or she plays the game. The greater the level of performance, the higher the ranking a player achieves as a member of the game. Also, performance against a higher ranking player will be weighted in the scoring of a lower ranking player for ranking purposes.

Having thus described our invention, we claim:

1. An amusement structure, comprising:

an elongated passageway;

a central divider wall separating said passageway into a pair of trackways;

a common entrance area having access to said pair of trackways;

a common gaming area connecting to the two trackways at their opposite ends;

means to observe activities in said gaming area from externally of the gaming area;

a plurality of sensors disposed along said trackway and in the gaming area and operative to generate electrical signals related to the positions and activities of participants in the passageway and gaming area;

sensory signal generators disposed along said trackway and in said gaming area; and a central computer connected to said sensors so as to receive signals from said sensors and connected to said sensory signal generators so as to control their operation; and said computer being operative to control the operation of the sensory signal generators as a function of the signals generated by said sensors.

2. The amusement structure of claim 1 wherein said sensory signal generators include displays and said central computer includes means for scoring the performance of the participants based on the outputs of said sensory signal generators and communicates the performance to the participants through the displays.

3. The amusement structure of claim 1 including:

a second elongated passageway;

a second central divider wall separating said second passageway into a second pair of trackways, one end of both of said second pairs of trackways being exposed adjacent to and connected to said common gaming area; and a second common gaming area connected to said second two trackways at their opposite ends.

4. The amusement structure of claim 1 wherein said plurality of sensors includes receivers for electromagnetic energy from transmitters carried by said participants.

5. The amusement structure of claim 4, further including directional electromagnetic transmitters adapted to be carried by the participants and electromagnetic receivers adapted to be carried by the participants, and said sensors include means for determining the receipt of a signal from an electromagnetic transmitter carried by one participant which is picked up by an electromagnetic receiver carried by a second participant.

6. The amusement structure of claim 1 wherein at least certain of said secondary signal generators include displays controlled by the central computer to simulate an adversary of participants.

7. The amusement structure of claim 1 in which certain of said sensors include transmitters of electromagnetic energy and receivers of reflected electromagnetic energy.

8. The amusement structure of claim 1 in which said means to observe activities in said gaming area from externally of the gaming area comprises a viewing room disposed immediately adjacent to the gaming area and including windows to allow the observation of activities within the gaming area from the viewing room.

9. An amusement gaming system adapted to be used by one or more participants, comprising:

weapons adapted to be carried by the participants, the weapons including trigger means for energizing the weapons to generate a directional emission from the weapons;

sensors adapted to be carried by the participants adapted to detect the receipt by the participant of an emission from the weapon of another participant;

an elongated passageway;

a central divider wall separating said passageway into a pair of trackways;

a plurality of sensors operative to generate electrical signals related to the positions and/or activities of participants;

displays disposed along said trackway; and a central computer connected to said sensors so as to receive signals from said sensors and connected to said displays so as to control their operation, said central computer including means for evaluating the performance of participants based on signals from said sensors and controlling the displays to provide information to the participants as to their performance.

10. The amusement gaming system of claim 9 further including a common gaming area connected to the two trackways at one of their ends; and a plurality of sensors and displays disposed in the gaming area.

11. The amusement gaming system of claim 10 further including means for observing activities in the gaming area from an area remote from said gaming area.

12. The amusement system of claim 11 wherein said means for observing activities in the gaming area from an area remote from said gaming area includes a viewing room disposed immediately adjacent said gaming area and having windows to allow the observation of activities within the gaming area from the viewing room.

* * * * *

UNITED STATES PATENT AND TRADEMARK OFFICE

CERTIFICATE OF CORRECTION

PATENT NO. : 5,320,362

DATED : June 14, 1994

INVENTOR(S) : Thomas Bear et al

It is certified that error appears in the above-indentified patent and that said Letters Patent is hereby corrected as shown below:

The title page should be deleted to appear as per attached title page.

Figures 1, 2 and 3 should be deleted and replaced with figures 1, 2 and 3 as shown on the attached sheets.

Signed and Sealed this

First Day of November, 1994

*Attest:*

*Attesting Officer*

Bruce Lehman

BRUCE LEHMAN

*Commissioner of Patents and Trademarks*

United States Patent [19]

Bear et al.

[11] Patent Number: 5,320,362

[45] Date of Patent: Jun. 14, 1994

[54] COMPUTER CONTROLLED AMUSEMENT STRUCTURE

[76] Inventors: Thomas Bear, 6559 Kolb; Robert Jordan, 15402 Angelique, both of Allen Park, Mich. 48101

[21] Appl. No.: 116,507

[22] Filed: Sep. 7, 1993

[51] Int. Cl.[5] ..... A63B 71/02; F41J 5/00

[52] U.S. Cl. ..... 273/440; 273/311; 273/445; 273/454; 273/460; 472/66

[58] Field of Search ..... 273/440, 311, 313, 444, 273/445, 446, 454, 460, 310; 472/62

[56] References Cited

U.S. PATENT DOCUMENTS

| | | | |
|---|---|---|---|
| 4,695,058 | 9/1987 | Carter, III et al. | 273/311 |
| 5,127,657 | 7/1992 | Ikezawa et al. | 273/310 |
| 5,219,316 | 6/1993 | Huffman | 472/62 |

*Primary Examiner*—William H. Grieb

*Attorney, Agent, or Firm*—Krass & Young

[57] ABSTRACT

An amusement system for use by one or more participants includes weapons which may be carried, aimed and triggered by the participants to fire objects, such as paint balls, or electromagnetic energy, such as laser light. The participants wear sensors which generate signals upon participant being "hit" by an emission. The system includes a structure having a series of elongated passageways. Each passageway is divided by a central wall into a pair of trackways which lead from common entrance area at one end to a gaming area at the opposite end. Viewing areas in which the activities of the participants in the gaming area may be observed are disposed adjacent to the gaming area. Sensors are disposed along the passageways and in the gaming areas to detect the positions and activities of the participants to provide the signals to a central computer. The computer controls active displays disposed along the passageway and in the gaming area which simulate weapons and special sound and visual effects such as explosions and the like and displays which provide information to the participants as to their scores. The computer generates scores based on signals from the sensors to evaluate the players.

12 Claims, 2 Drawing Sheets

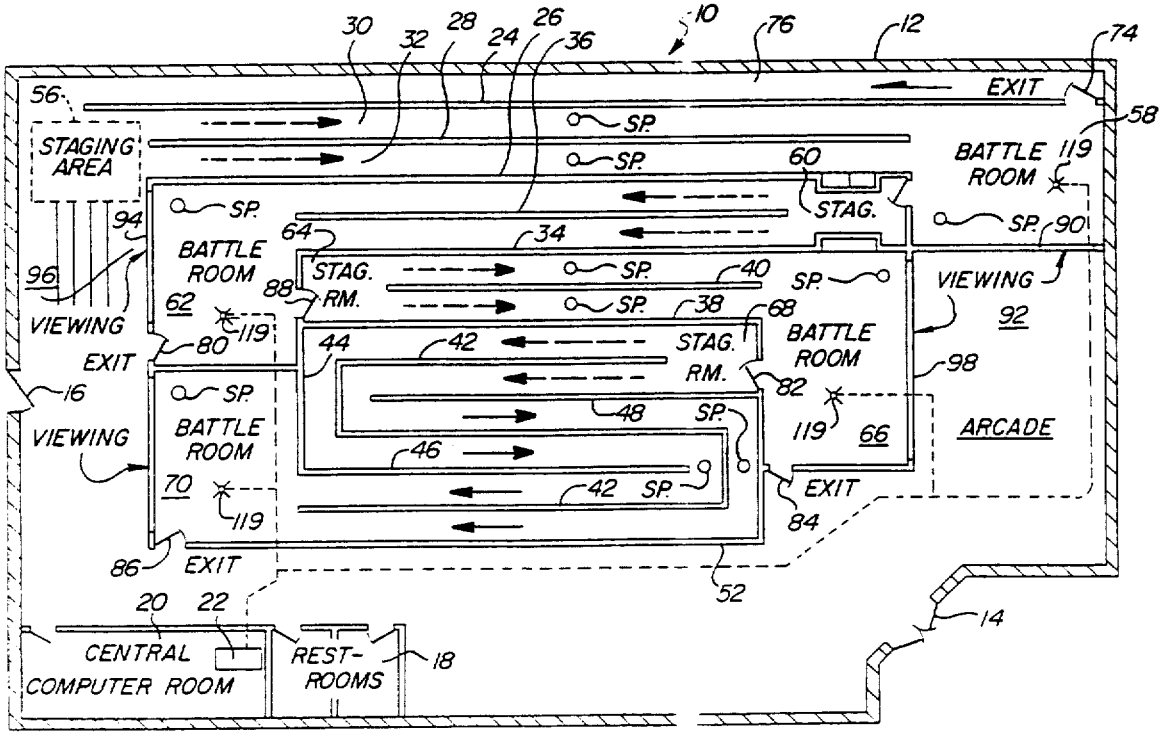

UNITED STATES PATENT AND TRADEMARK OFFICE

CERTIFICATE OF CORRECTION

PATENT NO. : 5,320,362
DATED : June 14, 1994
INVENTOR(S) : Thomas Bear et al.

It is certified that error appears in the above-indentified patent and that said Letters Patent is hereby corrected as shown below:

Column 1, Line 11, please delete "Background" and insert --Background of the invention--.

Column 2, Line 12, please delete "participant s" and insert --participants--.

Column 4, Line 14, please insert --the-- before "next".

Under references cited, please insert the following:

3,960,380 6/1976 Yokoi 273/101.1

4,102,532 7/1978 Van Jepmond et al. 273/1E 4,142,722 3/1979 Romano et al. 273/101.1

4,192,507 3/1980 Rains et al. 273/311

4,232,865 11/1980 Chen et al. 273/311

4,322,080 3/1982 Pennington 273/86B 4,844,475 7/1989 Saffer et al. 273/311

4,533,144 8/1985 Juarez et al. 273/311

4,545,583 10/1985 Pearman et al. 273/311

4,695,058 9/1987 Carter et al. 273/311

4,754,133 6/1988 Bleich 250/221

UNITED STATES PATENT AND TRADEMARK OFFICE

CERTIFICATE OF CORRECTION

PATENT NO. : 5,320,362

DATED : June 14, 1994

INVENTOR(S) : Thomas Bear, et al.

It is certified that error appears in the above-indentified patent and that said Letters Patent is hereby corrected as shown below:

Column 1, Line 38, Please delete "or "roller blades" ".

Signed and Sealed this

Twenty-seventh Day of December, 1994

*Attest:*

Bruce Lehman

BRUCE LEHMAN

*Attesting Officer*

*Commissioner of Patents and Trademarks*